US006176380B1

(12) United States Patent
Glories et al.

(10) Patent No.: US 6,176,380 B1
(45) **Date of Patent: *Jan. 23, 2001**

(54) FEEDING-BOTTLE TEAT

(76) Inventors: Serge Glories, Le Laurier Palaja, 11570 Cazilhac; Jean-Baptiste Drevet, 45 boulevard Saint-Michel, 75005 Paris, both of (FR)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/823,542

(22) Filed: Mar. 25, 1997

Related U.S. Application Data

(63) Continuation of application No. 08/532,677, filed as application No. PCT/FR94/00463.

(30) Foreign Application Priority Data

Apr. 23, 1993 (FR) ..... 93 04833

(51) Int. Cl.[7] ..... A61J 9/00
(52) U.S. Cl. ..... 215/11.1; 215/11.4; 606/236
(58) Field of Search ..... 215/11.1, 11.5, 215/11.4; 606/234, 236; 220/367.1, 913

(56) References Cited

U.S. PATENT DOCUMENTS 633,343 * 9/1899 Heany ..... 215/11.1
1,095,969 * 5/1914 Poore ..... 215/11.5
2,005,437 * 6/1935 Naum ..... 215/11.5
2,133,411 * 10/1938 Zohe ..... 215/11.5
2,513,896 * 7/1950 Searer ..... 215/11.5
2,546,681 * 3/1951 Searer ..... 215/11.5
2,661,001 * 12/1953 Alstadt et al. ..... 215/11.5
3,704,803 * 12/1972 Ponder ..... 215/11.5 X
4,586,621 * 5/1986 Dahan ..... 215/11.1
5,101,991 * 4/1992 Morifuji et al. ..... 215/11.5 X
5,747,083 * 5/1998 Raymond et al. ..... 215/11.3 X
5,860,541 * 1/1999 McIntyre et al. ..... 215/11.4

FOREIGN PATENT DOCUMENTS

1076710 * 7/1967 (GB) ..... 215/11.1

* cited by examiner

*Primary Examiner*—Gary E. Elkins
*Assistant Examiner*—Tri M. Mai
(74) *Attorney, Agent, or Firm*—Nixon Peabody LLP; Stuart J. Friedman

(57) ABSTRACT

A feeding-bottle teat comprising a flexible and pierced endpiece (8) designed to be put in the mouth of a child, and a fixing portion (10) for fixing the teat to the body (1) of a bottle; a tubular inner wall (12) lining its outer wall (7) and defining an annular chamber (15) which terminates in the vicinity of the base of the endpiece (8) and which is in permanent communication with the atmosphere via at least one orifice (11) formed through the outer wall (7) of the teat at the base of the annular chamber (15).

5 Claims, 2 Drawing Sheets

FEEDING-BOTTLE TEAT

This application is a Continuation of Ser. No. 08/532,677, filed as PCT/FR94/00463, Apr. 22, 1994, now abandoned.

The present invention relates to a feeding-bottle teat specially adapted for feeding babies.

Compared with breast feeding, bottle-feeding a baby presents drawbacks that are associated essentially with two factors. Firstly, there is no uniformity in the dose of milk delivered for constant sucking effort. The dose is a function of the depth of liquid present in the bottle, i.e. firstly on the quantity of milk it contains, which quantity decreases as it is consumed, and secondly on the inclination of the bottle relative to the horizontal. In particular, choking-style incidents are observed during the first mouthfuls taken by the baby because the baby is sucking hard and the liquid column is at its maximum, thereby causing too much liquid to reach the baby.

The second factor that impedes proper feeding of a baby lies in air penetrating into the bottle to replace the milk that has been consumed. In the simplest of teats, air penetrates via the milk outlet slit once the suction inside the bottle is greater than the suction force exerted by the baby. It is not unusual for the baby to swallow air at that moment which, together with irregularity in feed rate, constitutes the main cause of digestive troubles. Attempts have been made to mitigate that drawback by providing an inlet for air ingress into the bottle via an orifice other than the liquid outlet orifice. Thus, certain teats are installed on the bottle by a nut that presses a flange of the teat against the end surface of the neck of the bottle, the flange having one or more radial grooves that form channels through which outside air can penetrate when the suction inside the bottle is sufficient. Since the flange of the teat is made of rubber and can therefore be compressed, the tightness with which the teat is screwed onto the neck of the bottle adjusts the flow section of the channels so that they operate like a valve having an opening threshold. In use, such teats have nevertheless shown that it is difficult to adjust operation thereof, particularly for very young babies. It is necessary for air to penetrate into the bottle even under low suction, since the sucking power of a newborn baby is relatively small, so the teat is held against the neck of the bottle by a nut that is tightened very little. Unfortunately, under such circumstances, it is not unusual to observe milk leaking out, and that causes users to tighten the teat so much as to close the air passages completely, thereby eliminating the technical effect intended therefor.

An object of the present invention is to provide a solution to the two main causes of difficulty in digestion for newborn babies due to the way in which they are fed, i.e. to enable a given sucking force to deliver a constant dose of milk and to provide entirely satisfactory air ingress to the inside of the bottle while it is being emptied.

To this end, the present invention provides a feeding-bottle teat comprising a flexible and pierced endpiece designed to be put in the mouth of a child, and a fixing portion for fixing the teat to the body of a bottle, the teat comprising a tubular inner wall lining its outer wall and defining an annular chamber which terminates in the vicinity of the base of the endpiece and which is in permanent communication with the atmosphere via at least one orifice formed through the outer wall of the teat at the base of the annular chamber. By means of this disposition, the liquid sucked out by the baby is at constant pressure regardless of the quantity of liquid contained in the bottle, which pressure is atmospheric pressure. In addition, air penetration into the bottle does not require any initial adjustment and it adapts accurately to the quantity of liquid that the newborn baby has extracted.

In a preferred embodiment, at least the free end of the inner wall is flexible and, in the rest position, bears against the inside surface of the base of the flexible endpiece. This embodiment, particularly when the outside diameter of the free end is slightly greater than the inside diameter of the teat at the base of the endpiece, serves, when the bottle is moved from its in-use position to its vertical position with the teat on top, to prevent a small quantity of milk, in particular the quantity contained in the endpiece, flooding the annular chamber. In preferred manner, all of the inside wall of the teat lining is made of a material that is flexible and elastic, e.g. a silicone having all the necessary food grade qualities.

In another embodiment, the endpiece of the teat is integrally formed with the inner wall, the junction portion between the endpiece and the inner wall forming a zone through which slits are formed, the means for fixing the teat to the body of the bottle being constituted by a nut for clamping a flange of the inner wall against the end of the neck of the bottle, which nut includes a rigid dome provided with a central opening through which the endpiece is received and against the inside edge of which there presses the connection zone between the endpiece and the inner wall in which the slits are formed, at least one opening being formed in the rigid dome to place the space between the inner wall and the dome in communication with the atmosphere.

Other characteristics and advantages of the invention appear from the embodiments described below by way of example.

Reference is made to the accompanying drawings, in which.

Figure 1:
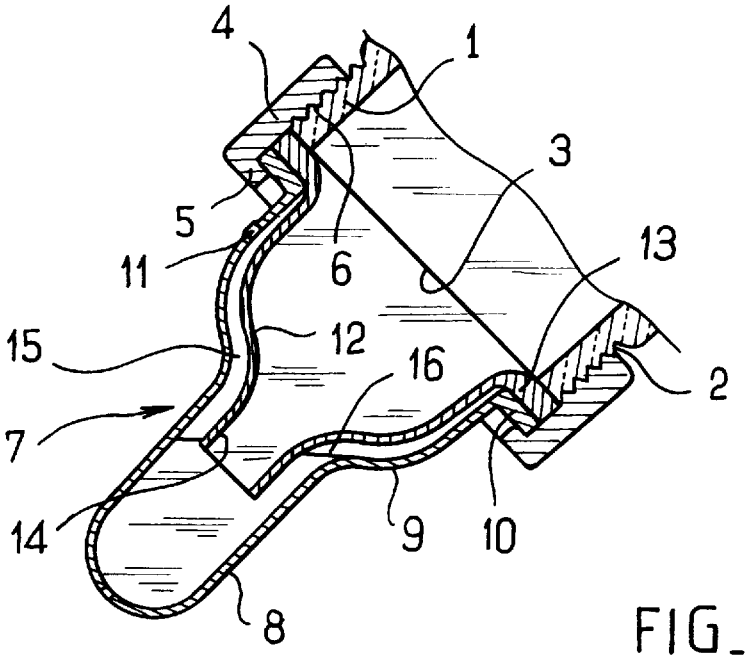
FIG. 1 is a section view of a first embodiment of the teat of the invention.

FIG. 1 shows the neck 1 of a feeding bottle having an outside thread 2 and an end face 3. The bottle also includes, likewise in known manner, a ring 4 having an end shoulder 5 and an inside thread 6 for co-operating with the outside thread 2 on the neck 1 so as to clamp the flange that is normally to be found on a teat between the surface 3 and the shoulder 5. In this figure, the ring 4 is used for the same purpose when fixing, in the same manner, the teat of the invention as described below.

The teat has an outer envelope 7 which is substantially identical in shape to known teats, i.e. it has a perforated endpiece 8 (with holes, slits, . . . ) connected to a dome-shaped portion 9 which is provided at its base with a flange 10 which forms the fixing flange of the outer envelope 7. In the vicinity of the ring 4, the envelope has an orifice 11 for putting its inside volume into communication with the outside atmosphere.

Inside the envelope 7, the teat of the invention has an inside wall 12 which, starting from a flange 13 designed to be superposed on the flange 10 of the envelope 7, forms a kind of lining for the portion 9 of the envelope 7 and terminates in a substantially cylindrical end portion 14 that opens out into the base of the endpiece 8. The two envelopes 7 and 12 are fixed to the neck 1 by the ring 4 which clamps both flanges 10 and 13 between the shoulder 5 and the surface 3. The envelopes are shaped in such a manner that when fitted to the neck 1 of a bottle, they define between them an annular space 15 which communicates with the outside atmosphere via the orifice 11.

When the bottle is full and up-ended to place the teat at the bottom, as shown in FIG. 1, i.e. when it is in the position in which it is used for feeding a baby, the endpiece 8 fills with liquid until the outlet of the portion 14 of the inner wall 12 is closed. A free surface 16 is then established in the intermediate space 15 between the two walls 7 and 12, and this surface 16 which is subjected to atmospheric pressure constitutes means for retaining the column of liquid in the bottle.

When the newborn baby applies a sucking force to the endpiece 8, he begins by extracting liquid contained in this endpiece, thereby lowering the level 16 and thus allowing the air contained in the intermediate space 15 to penetrate through the end 14 of the wall 12 so as to travel up the bottle. When the child stops sucking, the endpiece 8 returns to its initial shape and fills up again with liquid from the bottle until equilibrium similar to the preceding equilibrium is reestablished. It will be understood that this device ensures that sucking force is not influenced in any way by the depth of liquid in the bottle. The child sucks the endpiece 8 in which the depth of liquid is about 1 cm to 2 cm. This depth remains constant regardless of how full the bottle is.

Further, since ingress of air into the bottle for replacing the liquid that has been consumed encounters practically no resistance going round the neck 14 of the second envelope 12, the endpiece 8 practically never contains any bubbles of air, so the child does not swallow any. In addition, unlike prior art teats, air ingress never takes place through the slit or the orifices in the end of the endpiece 8 for delivering liquid to the child.

Figure 2:
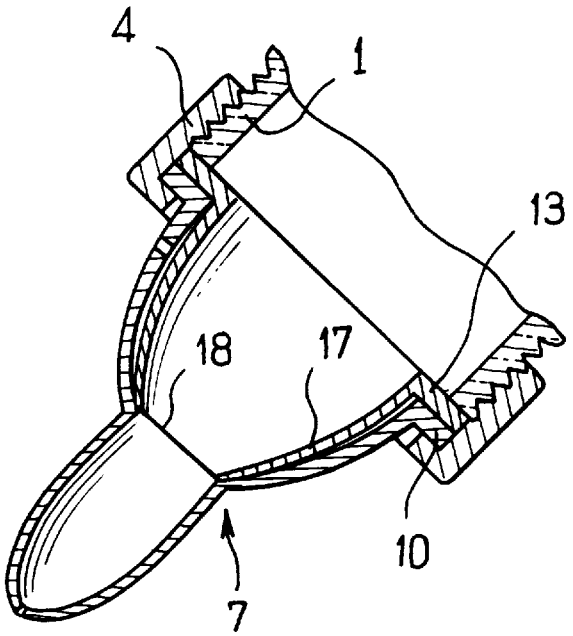
FIG. 2 shows a variant of the first embodiment.

The above disposition suffers from a minor drawback if the bottle is returned to the upright position before it is completely empty. Under such circumstances, the liquid contained in the endpiece 8 can fill the chamber 15 and reach the orifice 11 through which it can flow and dribble out. Nevertheless, it should be observed that by taking the precaution of never turning the bottle the rightway-up until it has been emptied, such leakage does not occur. All the same, to mitigate this minor drawback, the invention proposes another embodiment of the teat as shown in FIG. 2. In this embodiment, the wall 12 which is made entirely of material that is flexible and elastically deformable, has the shape of a dome 17 which is open at its crown and whose wall tapers towards the opening 18 so as to form a flexible lip. The relative dimensions of the portion 9 of the outer envelope 7 and of the inside portion 17 are such that the flexible lip is pressed lightly against the transition zone between the portion 9 of the envelope 7 and the endpiece 8. This forced contact can be obtained simply by providing for the lips surrounding the opening 18 of the inner wall to have an outside diameter that is slightly greater than the inside diameter of said transition zone between the portions 9 and 8 of the outer envelope 7. With this disposition, when the bottle is turned upright, the liquid contained in the endpiece 8 does not flow into the annular chamber 15 situated between the envelopes 7 and 17. It will be observed that the lips surrounding the opening 18 do not have the function of isolating the chamber 15 from the inside of the bottle, and that the phenomenon described with reference to FIG. 1 occurs in the device of FIG. 2 for the purpose of retaining the column of liquid contained in the bottle.

Figure 3:
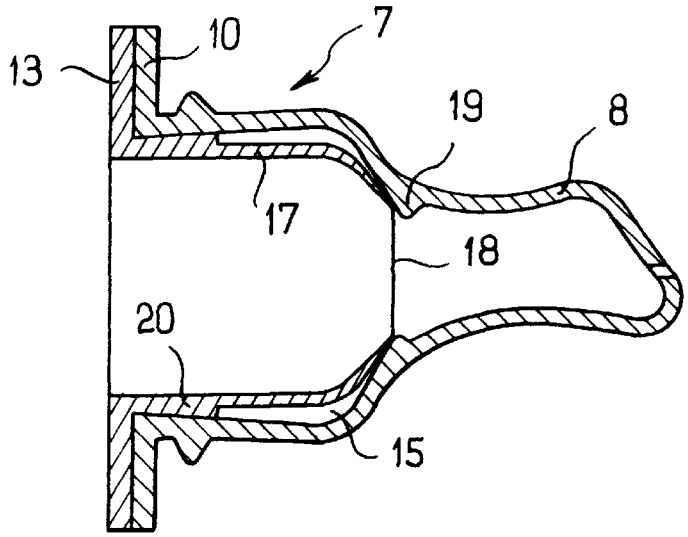
FIGS. 3 and 4 are orthogonal sections through a teat whose endpiece is morphologically adapted for sucking.
Figure 4:
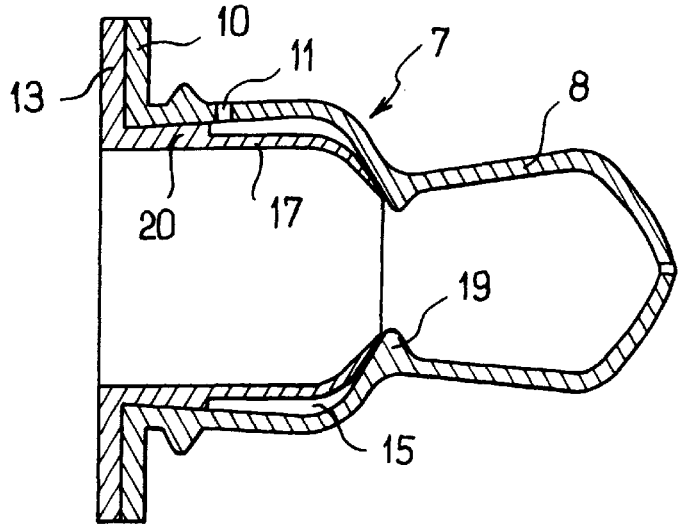

FIGS. 3 and 4 show an application of the variant embodiment described with reference to FIG. 2 to a so-called "physiological" teat, i.e. in which the endpiece 8 is of a shape that is specially adapted to the morphology of the mouth of a baby. Most of the elements already described with reference to the preceding figures are to be found in these figures with the same references. The inner wall 17 is in this case in the form of a tubular diaphragm whose lips adjacent to its opening 18 are very thin and bear against a reinforced portion 19 (i.e. a portion of greater thickness) of the envelope 7 in the transition zone between the dome-shaped portion 9 and the endpiece 8. By this disposition, the forces generated by the baby on the teat give rise to limited deformation of the wall forming the endpiece 8. Since the zone 19 is stiffer, given that it is thicker, transmission of the sucking force to the remainder of the teat is limited, and this applies both to the portion 9 and to the inner wall 17. It will also be observed that the base of the wall 17 is also reinforced to constitute a relatively thick portion 20 against which the base of the outer envelope 7 can press and be centered. Finally, it may be observed that the orifice 11 provided through the outer envelope 7 is situated on one side when the teat is in its in-use position, so that even if a small leak does take place from the endpiece 8 into the annular chamber 15, the liquid present in the annular chamber is situated at a level that is below the level of the orifice 11.

Figure 5:
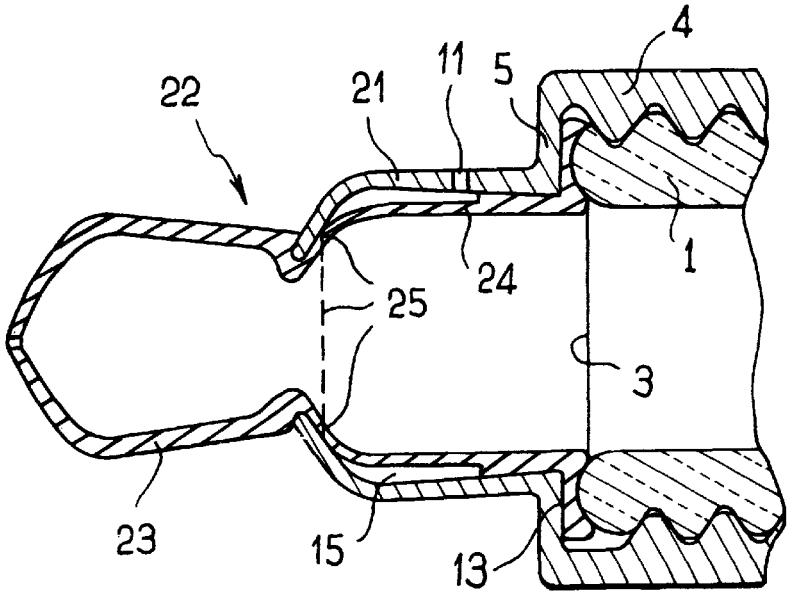
FIG. 5 is a section view through another embodiment of the invention.

Finally, FIG. 5 shows a second embodiment of a teat of the invention. In this case, the ring 4 is surmounted by a rigid portion 21 that is dome-shaped and that has an open crown. A flexible envelope 22 is received inside this rigid portion, the envelope itself being divided into two portions: a portion 23 outside the rigid dome 21 that forms the sucking endpiece of the teat; and a portion 24 inside the dome 21 that constitutes the flexible wall equivalent to the inner wall 12 or 17 of the preceding figures. The wall 24 has a portion that is narrowed and that has reduced wall thickness where it goes through the opening of the dome 21 against whose edges it bears, said zone having a plurality of slits 25 which subdivide this narrowed portion into a corresponding number of pseudo-lips suitable for being lifted away from the wall of the dome 21 under the effect of the endpiece 23 being sucked. Any suction inside the bottle will tend to cause air to penetrate substantially freely through the slits 25 since the envelope 24 at this point has very thin wall thickness and is therefore very easily deformed under the effect of a small difference in pressure between the liquid and the annular chamber 15 which communicates with the atmosphere via the orifice 11 formed through the rigid dome 21 that is integral with the ring 4.

We claim:

1. A feeding-bottle teat assembly comprising:

a dome-shaped portion;

a fixing portion at a base of said dome-shaped portion;

a perforated sucking end-piece connected to and extending from said dome-shaped portion proximate a junction zone opposed to said fixing portion; and means for fixing said fixing portion to a neck of a bottle, wherein said junction zone between said sucking end-piece and said dome-shaped portion is provided with at least one slit, said means for fixing said fixing portion to a neck of a bottle comprises a nut for clamping a flange of said fixing portion against an end of said bottle neck which nut includes a rigid dome provided with a central opening through which said sucking end-piece is received, said junction zone is provided with said slit being pressed against said rigid dome, and at least one opening is formed in the rigid dome.

2. A teat according to claim 1, wherein said junction zone is of reduced thickness.

3. A feeding bottle teat, comprising:

an outer wall defining an inside volume and having a dome-shaped portion with a base provided with a fixing flange and a perforated end-piece connected to said dome-shaped portion by a transition zone and extending therefrom opposed to said fixing flange; and a partial inner wall shaped as an inner liner of said dome-shaped portion and defining in said inside volume with said dome-shaped portion an annular chamber closed at the base of said dome-shaped portion and open to said inside volume proximate to said transition zone, at least one orifice being provided in said dome-shaped portion near the base thereof for connecting said annular chamber to the atmosphere.

4. A teat according to claim 3, wherein said inner liner is dome shaped, has a base provided with a fixing flange and has an opening opposed to said base, at least said opening of said inner liner being flexible and bearing against said dome-shaped portion of said outer wall.

5. A teat according to claim 4, wherein said inner wall tapers towards said opening (18).

* * * * *